US009622926B2

(12) United States Patent
Andersson

(10) Patent No.: US 9,622,926 B2
(45) Date of Patent: Apr. 18, 2017

(54) WHEELCHAIR COMPRISING ENERGY ABSORBER

(71) Applicant: PERMOBIL AB, Timra (SE)

(72) Inventor: Magnus Andersson, Sundsvall (SE)

(73) Assignee: Permobil AB, Timra (SE)

( * ) Notice: Subject to any disclaimer, the term of this patent is extended or adjusted under 35 U.S.C. 154(b) by 0 days.

(21) Appl. No.: 14/771,922

(22) PCT Filed: Mar. 6, 2014

(86) PCT No.: PCT/SE2014/050274
§ 371 (c)(1),
(2) Date: Sep. 1, 2015

(87) PCT Pub. No.: WO2014/137279
PCT Pub. Date: Sep. 12, 2014

(65) Prior Publication Data

US 2016/0000619 A1 Jan. 7, 2016

(30) Foreign Application Priority Data

Mar. 6, 2013 (SE) ..... 1350265

(51) Int. Cl.
*A61G 5/10* (2006.01)
*A61G 3/00* (2006.01)
*A61G 3/08* (2006.01)

(52) U.S. Cl.
CPC ..... *A61G 5/10* (2013.01); *A61G 3/006* (2013.01); *A61G 3/0808* (2013.01)

(58) Field of Classification Search
CPC ..... A61G 5/10; A61G 3/006; A61G 3/0808
(Continued)

(56) References Cited

U.S. PATENT DOCUMENTS 5,324,243 A * 6/1994 Wilkinson ..... A63B 21/055 482/121
5,431,524 A * 7/1995 Antal ..... A61G 3/0209 296/61

(Continued)

FOREIGN PATENT DOCUMENTS

DE 9108317.6 8/1991
DE 102007001865 8/2007

OTHER PUBLICATIONS

International Search Report for International Patent Application No. PCT/SE2014/050274 mailed May 15, 2014.

*Primary Examiner* — Jacob Knutson
(74) *Attorney, Agent, or Firm* — McAndrews, Held & Malloy, Ltd.

(57) ABSTRACT

The present disclosure relates to a wheelchair (1) comprising: a chassis (3), a seat system (5) attached to the chassis (3), which seat system (5) has a backrest (5*b*) having a front side (5*c*) and a backside (5*d*), and an energy absorber (9) having a proximal end (9*a*) attached to the seat system (5) or joining the chassis (3), a distal end (9*b*) having means that enable attachment of straps or belts to the distal end (9*b*), and an intermediate portion (9*c*) extending from the proximal end (9*a*) to the distal end (9*b*) in a direction from the front side (5*c*) towards the back side (5*d*), wherein the intermediate portion (9*c*) has a curved portion adapted to straighten and plastically deform when the energy absorber (9) is subjected to a pulling force above a predetermined threshold.

15 Claims, 8 Drawing Sheets

(58) Field of Classification Search
USPC ..... 280/288.4, 292, 293
See application file for complete search history.

(56) References Cited

U.S. PATENT DOCUMENTS

| | | | | | |
|---|---|---|---|---|---|
| 5,713,821 | A * | 2/1998 | Nissen | A63B 23/04 | 482/114 |
| 6,048,292 | A * | 4/2000 | Gasquez | A61G 5/02 | 280/304.1 |
| 6,500,104 | B1 * | 12/2002 | Rich | A63B 21/04 | 482/123 |
| 6,840,894 | B2 * | 1/2005 | Lerner | A63B 21/0552 | 482/121 |
| 7,040,847 | B1 * | 5/2006 | Cardona | A61G 3/0808 | 410/12 |
| 8,162,809 | B1 * | 4/2012 | Eastwood | A63B 21/0442 | 482/123 |
| 2004/0152569 | A1 * | 8/2004 | Lerner | A63B 21/0552 | 482/124 |
| 2005/0233875 | A1 * | 10/2005 | Clarke | A63B 21/00043 | 482/123 |
| 2006/0194679 | A1 * | 8/2006 | Hatcher | A63B 21/04 | 482/123 |
| 2008/0111341 | A1 * | 5/2008 | Borisoff | A61G 5/08 | 280/250.1 |
| 2008/0247837 | A1 * | 10/2008 | Cardona | A61G 3/0808 | 410/23 |
| 2013/0280002 | A1 * | 10/2013 | Girardin | A61G 3/0808 | 410/7 |

* cited by examiner

WHEELCHAIR COMPRISING ENERGY ABSORBER

TECHNICAL FIELD

The present disclosure generally relates to a wheelchair and in particular to a wheelchair having means for securing the wheelchair in a vehicle for transportation of the wheelchair in the vehicle.

BACKGROUND

When a wheelchair is to be moved a greater distance it may be transported in a motor vehicle such as a bus or a car. The wheelchair occupant may occupy the wheelchair seat during such transport. For this purpose, the interior of the vehicle may be specially constructed or modified to be able to receive a wheelchair. In order to transport the wheelchair it is secured inside the vehicle for example by means of straps, and the wheelchair occupant may be strapped to the wheelchair for example by means of a safety belt. By securing the wheelchair in the vehicle in this manner, movement of the wheelchair relative to the vehicle is restricted in the event of an accident.

One example of securing a wheelchair in a vehicle is presented in WO2006048636 which discloses a flooring structure for mounting on a vehicle floor. The structure has four anchors, two for attachment to the back of the wheelchair and two for the attachment to the front of the wheelchair.

Another example of securing a wheelchair inside a vehicle is to secure the wheelchair by means of extensible belts fixed to floor rails arranged on the vehicle floor. These belts are attached to anchor points on the wheelchair chassis to restrict movement of the wheelchair in case of strong deceleration of the vehicle.

One problem with existing solutions is that the anchoring may not be robust enough especially for wheelchairs carrying heavy occupants. Moreover, current solutions do not provide sufficient protection from neck injuries in the event of a frontal collision.

SUMMARY

In view of the above, a general object of the present disclosure is to provide a wheelchair which solves or at least mitigates the problems of the prior art.

Hence, according to a first aspect of the present disclosure there is provided a wheelchair comprising: a chassis; a seat system attached to the chassis, which seat system has a backrest having a front side and a backside; and an energy absorber having a proximal end attached to the seat system or joined with the chassis, a distal end having means that enable attachment of straps or belts to the distal end, and an intermediate portion extending from the proximal end to the distal end in a direction from the front side towards the back side, wherein the intermediate portion has a curved portion adapted to straighten and plastically deform when the energy absorber is subjected to a pulling force above a predetermined threshold.

An effect which may be obtainable thereby is that the energy absorber can absorb energy in case of a frontal collision of the vehicle. In particular, the energy absorber which at its distal end is secured to e.g. straps or belts and at the proximal end is connected to or joins the seat system or chassis may deform plastically by straightening. Hence, upon impact such a wheelchair motion may be obtained which allows the seat system or chassis to move a distance corresponding to the plastic deformation of the energy absorber in the forward direction of the vehicle. The backrest and hence the headrest thus follows the motion path of the occupant during collision and reduces the backward momentum of the occupant as he or she is received by the backrest after the collision impact.

According to one embodiment the intermediate portion extends from the proximal end to the distal end in one plane.

According to one embodiment the proximal end of the energy absorber is attached to a backside of a seat part of the seat system.

According to one embodiment the backside has mounting means and the proximal end of the energy absorber has corresponding mounting means for attaching the proximal end to the backside of the seat part.

According to one embodiment the proximal end of the energy absorber is attached to a lower end of a backside of the backrest.

According to one embodiment the energy absorber has a first arm and a second arm, each of the first arm and the second arm having a proximal end, a distal end and an intermediate portion which together define the proximal end, the distal end and the intermediate portion, respectively, of the energy absorber.

According to one embodiment the intermediate portion of each of the first arm and the second arm each have a curved portion, wherein the curved portion of the first arm faces the curved portion of the second arm.

According to one embodiment the energy absorber comprises a connecting portion which joins the proximal ends of the first arm and the second arm.

According to one embodiment the connecting portion has a curved portion which extends in between the curved portion of the first arm and the curved portion of the second arm.

According to one embodiment the curved portion of the connecting portion extends beyond the curved portion of the first arm and the curved portion of the second arm in a direction from the proximal end towards the distal end.

According to one embodiment the curved portion of the connecting portion which extends beyond the curved portion of the first arm and the curved portion of the second arm has a section which is wider than a minimal distance between the curved portion of the first arm and the curved portion of the second arm.

According to one embodiment the mounting means of the energy absorber comprise openings arranged to receive respective bolts, and wherein the mounting means of the backside has corresponding openings.

According to one embodiment the energy absorber is attached symmetrically to a backside of a seat part of the seat system with the first arm attached at one side of a symmetry axis extending in a direction from an end of the backrest which is closest to the chassis towards a headrest end of the backrest and the second arm attached at the other side of the symmetry axis.

According to one embodiment the means that enable attachment of straps or belts at the distal end comprise loops.

According to one embodiment the energy absorber is made of low carbon steel or low alloy steel.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1A:
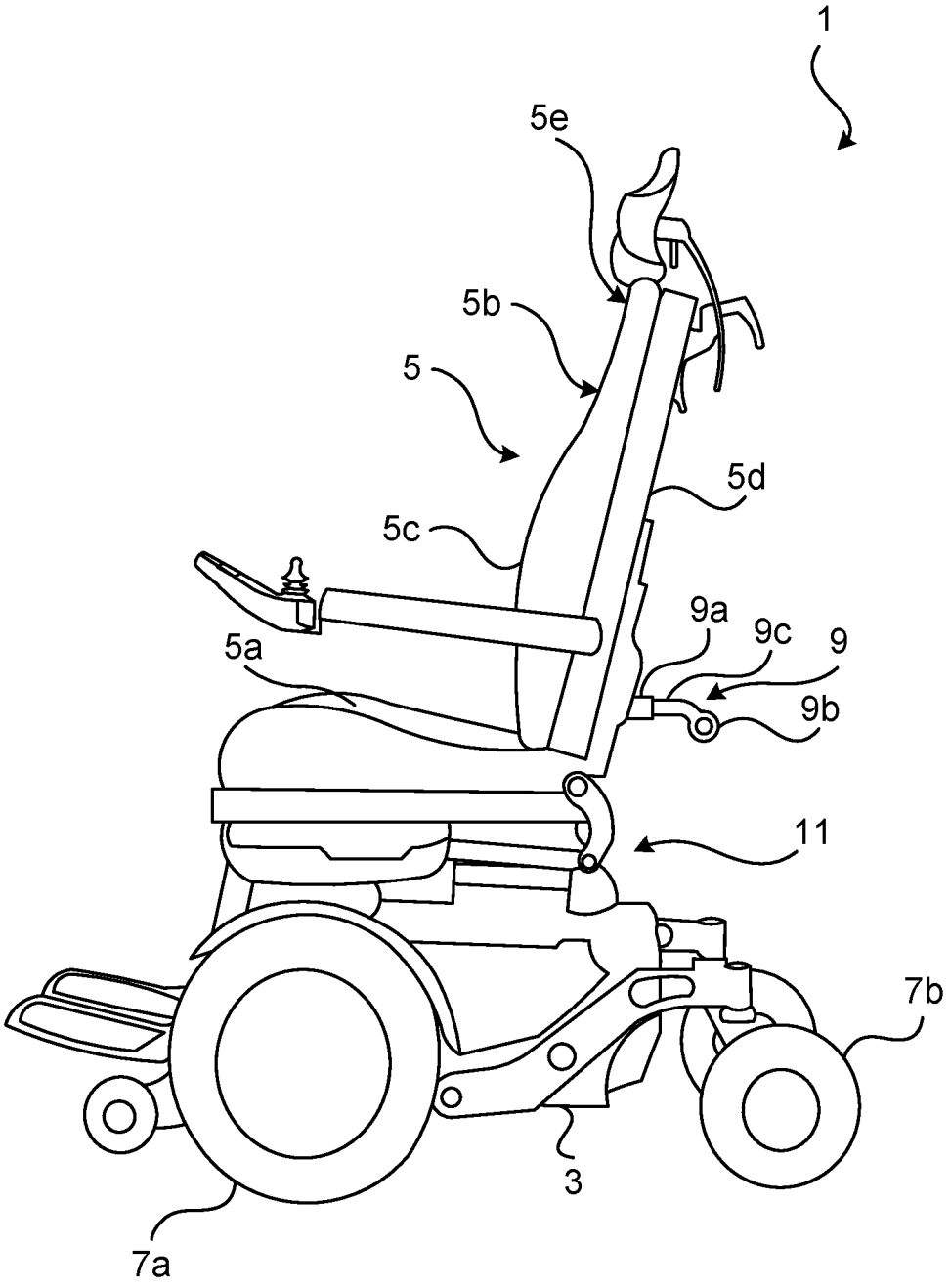
FIG. 1*a* is a schematic side view of a wheelchair comprising an energy absorber.

FIG. 1*a* depicts a schematic side view of an example of a wheelchair 1. The wheelchair 1 comprises a chassis 3, a seat system 5, wheels 7*a* and 7*b* and an energy absorber 9. The exemplified wheelchair 1 is of front wheel drive type. It should however be noted that the wheelchair alternatively could be of for example midwheel drive type, back wheel drive type, four wheel drive type or six wheel drive type.

The exemplified wheelchair 1 is an electric wheelchair. Hence, the wheelchair 1 may comprise a battery and a motor which may be attached to the chassis 3. The battery may be electrically coupled to the motor wherein the motor is mechanically coupled to the wheels 7*a* and 7*b* for driving the wheelchair 1.

Figure 1B:
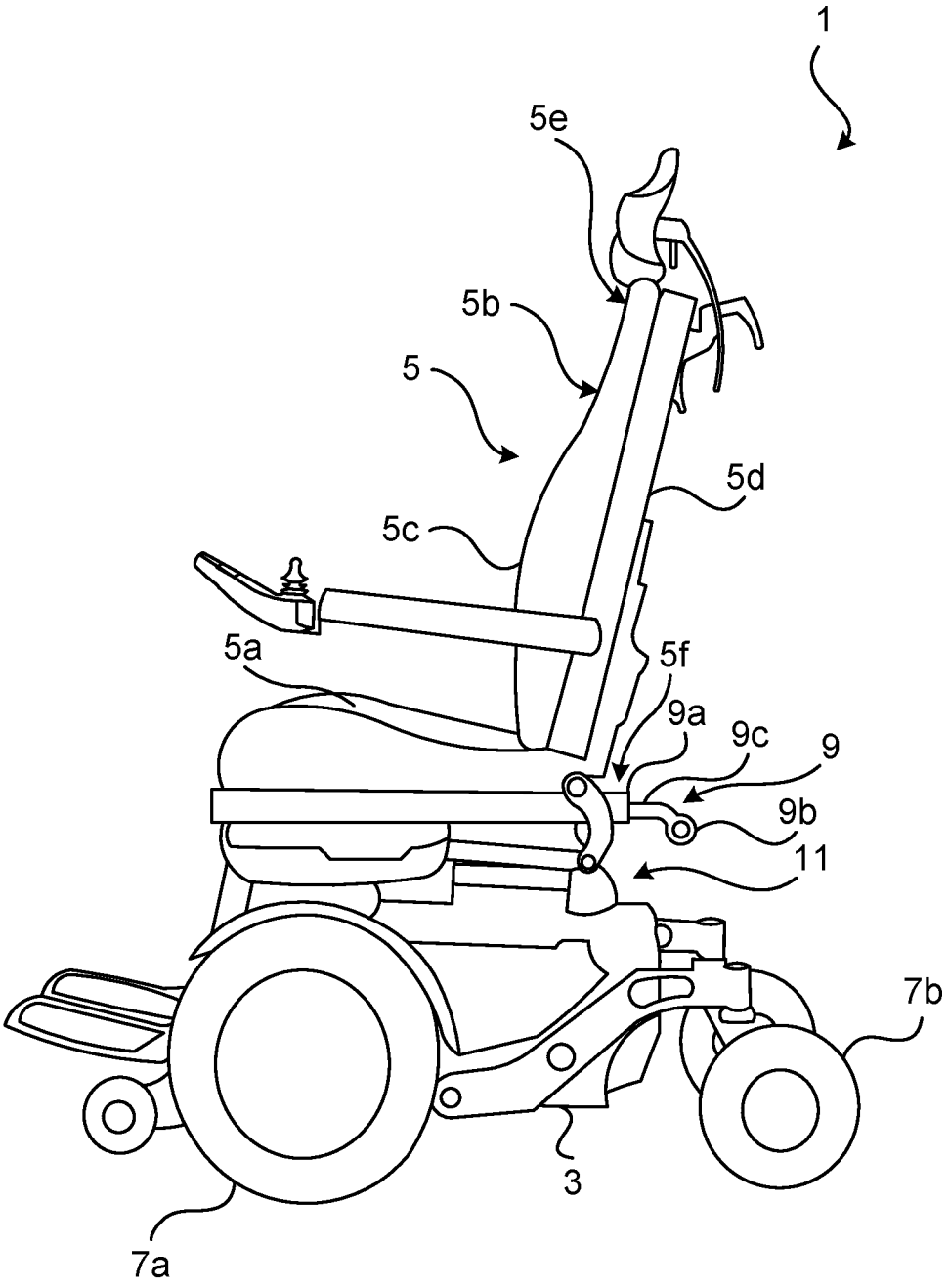
FIG. 1*b* is a schematic side view of another example of a wheelchair comprising an energy absorber.

The seat system 5 comprises a seat part 5*f*, as shown in FIG. 1*b*, a cushion 5*a* attached to the seat part 5*f*, a backrest 5*b*, and a seat support 11. The seat part 5*f* is attached to the chassis 3 by means of the seat support 11. The seat support 11 may according to one variation have a lift function and/or a tilt function. The cushion 5*a* has an upper side for seating an occupant and a lower side facing the chassis 3. The backrest 5*b* has a front side 5*c* towards which a seat occupant may lean and a backside 5*d* facing the opposite direction. The backrest 5*b* further has a headrest end 5*e* defining a headrest, or alternatively, which is arranged to receive a headrest.

The energy absorber 9 is preferably made of metal, for example low carbon steel or low alloy steel. The energy absorber 9 has a proximal end 9*a*, a distal end 9*b* and an intermediate portion 9*c* extending between the proximal end 9*a* and the distal end 9*b*. According to the present example, the proximal end 9*a* is attached to the seat system 5. The energy absorber 9 is attached to the seat system 5 in such a way that the intermediate portion 9*c* extends from the proximal end 9*a* to the distal end 9*b* in a direction generally from the front side 5*c* towards the back side 5*d*. The proximal end 9*a* may for example be attached to the backside 5*d* of the backrest 5*b*, or to the lower side of the cushion 5*a*. According to one variation hereof, the proximal end 9*a* is attached to the lower portion of the backside 5*d* of the backrest 5*b*, as shown in FIG. 1*a*. As an alternative to attaching the energy absorber to the seat system, the energy absorber could be joined with the chassis. To this end, the energy absorber could either be a separate device, as the energy absorbers depicted in FIGS. 2*a* and 2*b*, attached to the chassis or it could be integrated with the chassis. Furthermore, it is envisaged that according to one variation of the wheelchair the seat system and the chassis has a respective energy absorber attached thereto or integrated therewith.

The distal end 9*b* of the energy absorber 9 has means allowing it to be secured to the inside of a vehicle by means of straps, belts or other fixing means. The energy absorber 9 is thus arranged to absorb a pulling force in the event of an accident during which the wheelchair 1 is thrown in the forward direction, i.e. the direction in which the vehicle was traveling prior to the deceleration resulting from impact. The pulling force acts in a general direction from the front side 5*c* towards the backside 5*d* of the backrest 5*b*, and thus restricts forward movement of the wheelchair 1.

FIG. 1*b* shows a schematic side view of wheelchair 1 with the energy absorber 9 attached to the seat part 5*f* of the seat system 5. The seat part 5*f* may for example comprise a seat frame member which is mounted to the chassis 3, and to which the seat cushion is mounted. In particular, the energy absorber 9 may according to one variation be attached to the seat support 11 which connects the seat system 5 to the chassis 3. The energy absorber 9 in FIG. 1*b* is thus located lower on the wheelchair 1 than in the example in FIG. 1*a*.

Figure 2A:
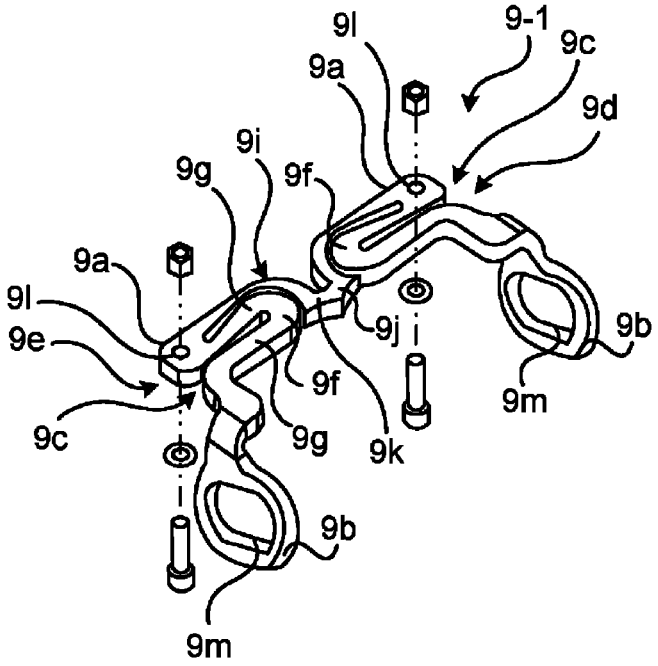
FIG. 2*a* depicts an exploded view of an energy absorber.

FIG. 2*a* is an exploded view of one example of an energy absorber 9. The exemplified energy absorber 9-1 comprises a first arm 9*d* and a second arm 9*e*. Each of the first arm 9*d* and the second arm 9*e* has a proximal end 9*a*. Each of the first arm 9*a* and the second arm 9*e* has a distal end 9*b*. According to the example in FIG. 2, the proximal ends 9*a* and distal ends 9*b* of the first arm 9*d* and the second arm 9*e* define the proximal end and distal end, respectively, of the energy absorber 9-1.

The proximal end 9*a* and the distal end 9*b* of the first arm 9*d* and the second arm 9*e* are joined by means of respective intermediate portions 9*c*. The proximal end 9*a*, the distal end 9*b*, and the intermediate portion 9*c* of each of the first arm 9*d* and the second arm 9*e* may extend in the same plane. The intermediate portion 9*c* of each of the first arm 9*d* and the second arm 9*e* comprises a curved portion 9*f*. The curved portion 9*f* of each of the first arm 9*d* and the second arm 9*e* is adapted to plastically deform and straighten when opposite forces acting on the proximal ends 9*a* and the distal ends 9*b* exceeds a predetermined threshold value.

According to the example in FIG. 2*a*, the curved portion 9*f* of the intermediate portion 9*c* of the first arm 9*d* faces the curved portion 9*f* of the intermediate portion 9*c* of the second arm 9*e*. Each curved portion 9*f* joins a respective proximal end 9*a* and distal end 9*b* via legs 9*g*. The curved portion 9*f* of an 3*o* intermediate portion 9*c* of each of the first arm 9*d* and the second arm 9*e* may according to one variation have such a curvature that the leg 9*g* joining the proximal end 9*a* and the leg 9*g* joining the distal end 9*b* are essentially parallel. The two legs 9*g* of any of the first arm 9*d* and the second arm 9*e* may hence be seen to be at an angle of about 180° joined via a curved portion 9*f*.

According to the example shown in FIG. 2*a*, the energy absorber 9-1 comprises a connecting portion 9*i* which joins the proximal ends 9*a* of the first arm 9*d* and the second arm 9*e*. The connecting portion 9*i* has a curved portion 9*j* which extends in between the curved portion 9*f* of the first arm 9*d* and the curved portion 9*f* of the second arm 9*e*, which face each other at a distance. The curved portion 9*j* of the connecting portion 9*i* extends beyond the curved portion 9*f* of the first arm 9*d* and the curved portion 9*f* of the second arm 9*e* in a direction from the proximal end 9*a* towards the distal end 9*b*. In particular, for the exemplified energy absorber 9-1, the curved portion 9*j* of the connecting portion 9*i* which extends beyond the curved portion 9*f* of the first arm 9*d* and the curved portion 9*f* of the second arm 9*e* has a section 9*k* which is wider than the minimal distance between the curved portion 9*f* of the first arm 9*d* and the curved portion 9*f* of the second arm 9*e*. The section 9*k* may hence act as a retaining element which retains the curved portions 9*f* of the first arm 9*d* and the second arm 9*e* when the energy absorber 9-1 is subjected to a moderate pulling force, below a predetermined threshold. The predetermined threshold is determined by design parameters of the energy absorber, such as material yield strength and dimensions of the material. The curved portion 9*j* of the connecting portion 9*i* follows the curvature of the curved portions 9*f* as it extends in between the curved portions 9*f* of the first arm 9*d* and the second arm 9*e*, and it may follow the curvature of the curved portions 9*f* as it extends beyond the curved portions 9*f* to thereby act as a retaining element.

The energy absorber 9-1 is mounted to the seat system 5 or to the rear end of the chassis 3 of wheelchair 1 at its proximal ends 9*a*. According to the present example, each proximal end 9*a* of the energy absorber 9-1 has mounting means 9*l* for attaching the energy absorber 9-1 to the backside 5*d* of the backrest 5*b* or to the rear end of the chassis 3. The mounting means 9*l* are here exemplified by through openings extending from the upper surface to the lower surface of the proximal ends 9*a*, and are arranged to receive fastening means such as bolts. The walls defining the openings may be threaded or non-threaded. The seat system 5, e.g. the backside 5*d* of the backrest 5*b*, and/or the rear end of the chassis has corresponding mounting means for attaching the energy absorber 9-1 thereto. In the present example, the mounting means of the seat system 5 comprises openings arranged to receive the fasteners extending through the openings of the proximal ends 9*a* of the energy absorber 9-1.

The energy absorber 9-1 is attached in a symmetric manner to the seat system 5 or to the rear end of the chassis 3. Thus each of the first arm 9*d* and the second arm 9*e* is attached to the seat system or to the rear end of the chassis at a respective side of a symmetry axis extending in a direction from an end of the backrest 5*b* which is closest to the chassis 3 towards the headrest end 5*e* of the backrest 5*b*. The symmetry axis is hence a vertical axis when the wheelchair 1 is positioned on horizontal ground. By attaching the energy absorber 9-1 in a symmetric manner relative to the symmetry axis, the lateral movement of the seat system 5 in a specific direction may be restricted in the event of an accident. This effect may in particular be achieved by fixing the two arms at a respective side of the symmetry axis.

The distal ends 9*b* of the energy absorber 9-1 has means 9*m* that enable attachment of straps, belts or similar fastening means thereto such that the energy absorber 9-1, and hence the wheelchair 1, may be secured inside a vehicle. According to the present example, the distal ends 9*b* comprise loops but alternative means such as hooks are also contemplated. The loop of the first arm 9*e* and the loop of the second arm 9*e* are oriented in a manner such that their respective openings face each other. Thereby the dimension of the material which joins the loops with the legs 9*g* may be larger in the direction of the pulling force than otherwise. This may typically be the case if for example the energy absorber has been manufactured from sheet metal that has a thickness dimension and width and length dimensions, where the thickness dimension is several orders smaller than the width and length dimensions of the arms of the energy absorber manufactured therefrom.

Figure 2B:
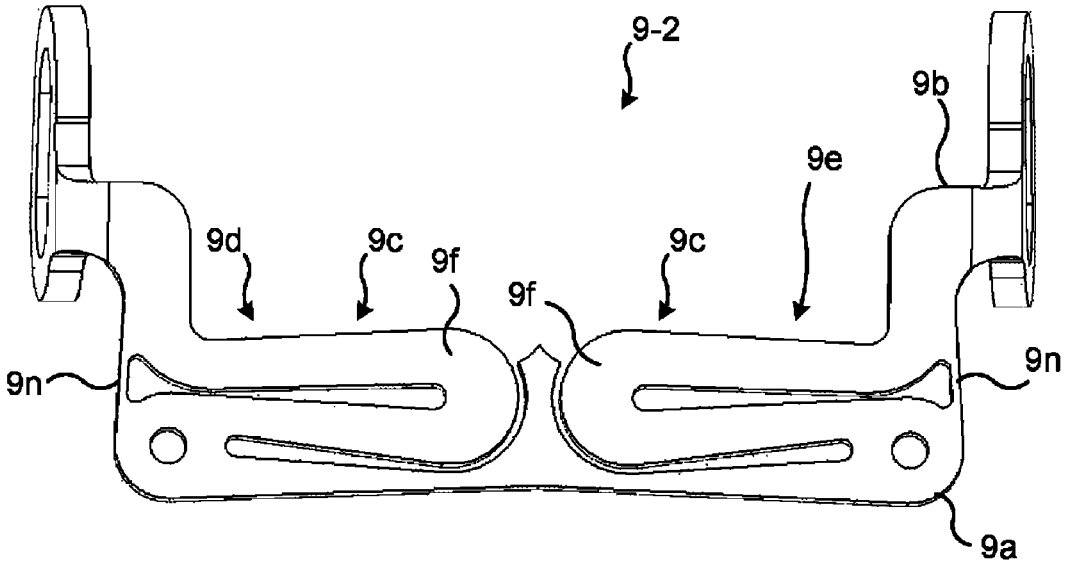
FIG. 2*b* depicts a top view of another example of an energy absorber.

FIG. 2*b* depicts another example of an energy absorber. Energy absorber 9-2 is essentially identical to energy absorber 9-1, except that energy absorber 9-2 comprises securing portions 9*n* which prevent deformation in the form of straightening of the curved portions 9*f* until the energy absorber 9-2 is subjected to a pulling force essentially corresponding to an impact or crash load. The open end of each curved portion 9*f* is closed by means of a securing portion 9*n*, which extends between and connects the proximal end 9*a* and the distal end 9*b* at the lateral side of the energy absorber 9-2. Each securing portion 9*n* has smaller dimensions than the curved portion 9*f*. The securing portions 9*n* will hence break at a certain pulling force which is lower than a force that would break the curved portions 9*f*. In particular, the securing portions 9*n* are designed to break at loads corresponding to the impact associated with a crash. The dimensions of the securing portions 9*n* should thus be designed dependent of the weight of the wheelchair with which the energy absorber 9-2 is to be used.

When the securing portions 9*n* have broken or snapped the curved portions are able to deform and straighten out. By means of this design, it can be ensured that no deformation of the curved portions occurs when fastening a wheelchair in a vehicle by means of the energy absorber 9-2. Moreover, the security portions 9*n* may also function as a security check to visually determine whether the energy absorber 9-2 is unaffected.

The securing portions 9*n* may be integrated with the energy absorber 9-2 as shown in FIG. 2*b*, or separate parts secured to the open ends of the curved portions.

The energy absorber 9-2 may be attached to a wheelchair in the same manners as the energy absorber 9-1.

The function of the energy absorber 9-1 will now be described in more detail with reference to FIGS. 3*a*-4*b*. Energy absorber 9-2 functions in a similar manner, except that the securing portions 9*n* maintains the curved portions 9*f* in their curved state until the energy absorber 9-2 is subjected to a pulling force corresponding to an impact. The energy absorber 9-1 may commence deformation prior to reaching such load levels.

Figure 3A:
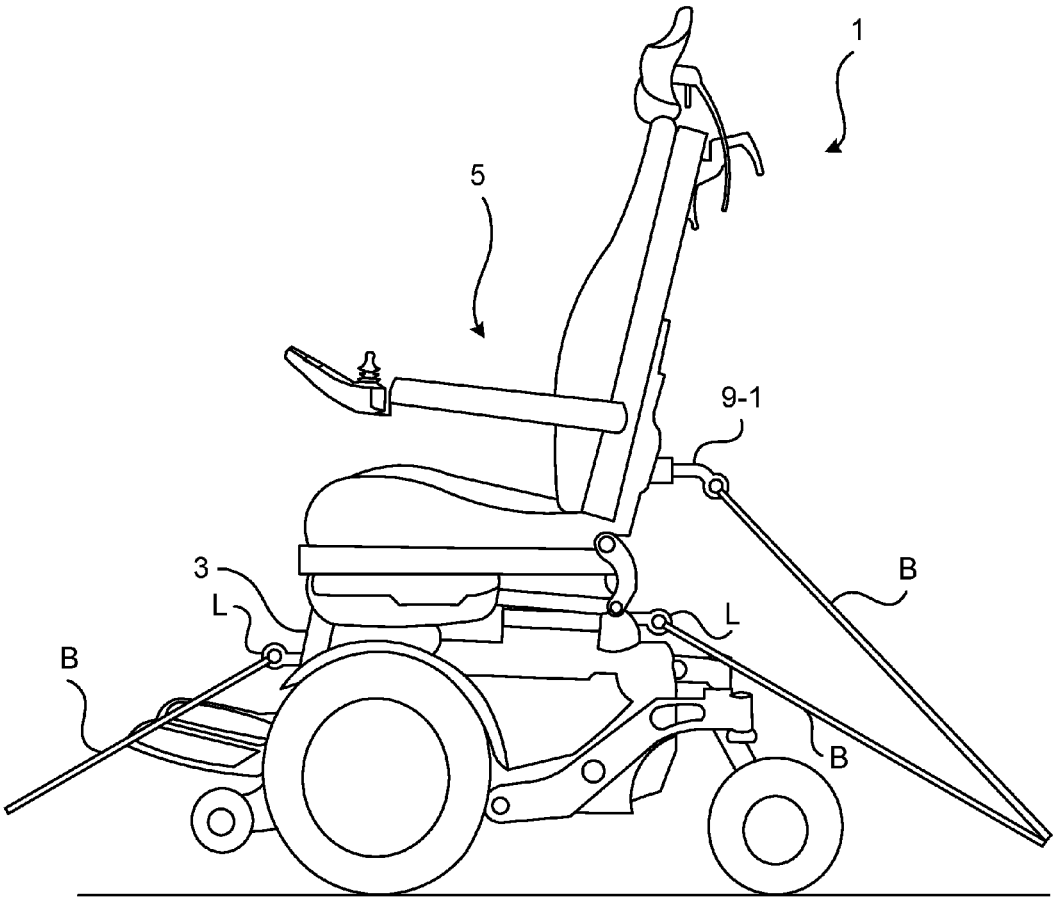
FIG. 3*a* is a schematic side view of a wheelchair fixed inside a vehicle.

FIG. 3*a* depicts a schematic side view of wheelchair 1 when it has been secured inside a vehicle prior to the wheelchair 1 being subjected to a strong decelerating force. As can be seen, also the chassis 3 of the wheelchair 1 may be provided with means for fastening the wheelchair 1. According to the example in FIG. 3*a*, these means are loops L which allow attachment of belts B or straps fixed to a floor rail or similar device. The chassis 3 may be provided with such loops L at its front side and back side such that the chassis 3 may be secured inside the vehicle from the front and the back. There may for example be two loops L arranged at the front side of the chassis 3, and two loops L at the back side of the chassis 3. The location of the loops L may be chosen such that the forces acting on the chassis 3 in the event of strong deceleration are essentially evenly distributed in the chassis 3. Straps or belts B are also attached to the distal ends 9*b* of the energy absorber 9, which according to the example is attached to the seat system 5.

Figure 3B:
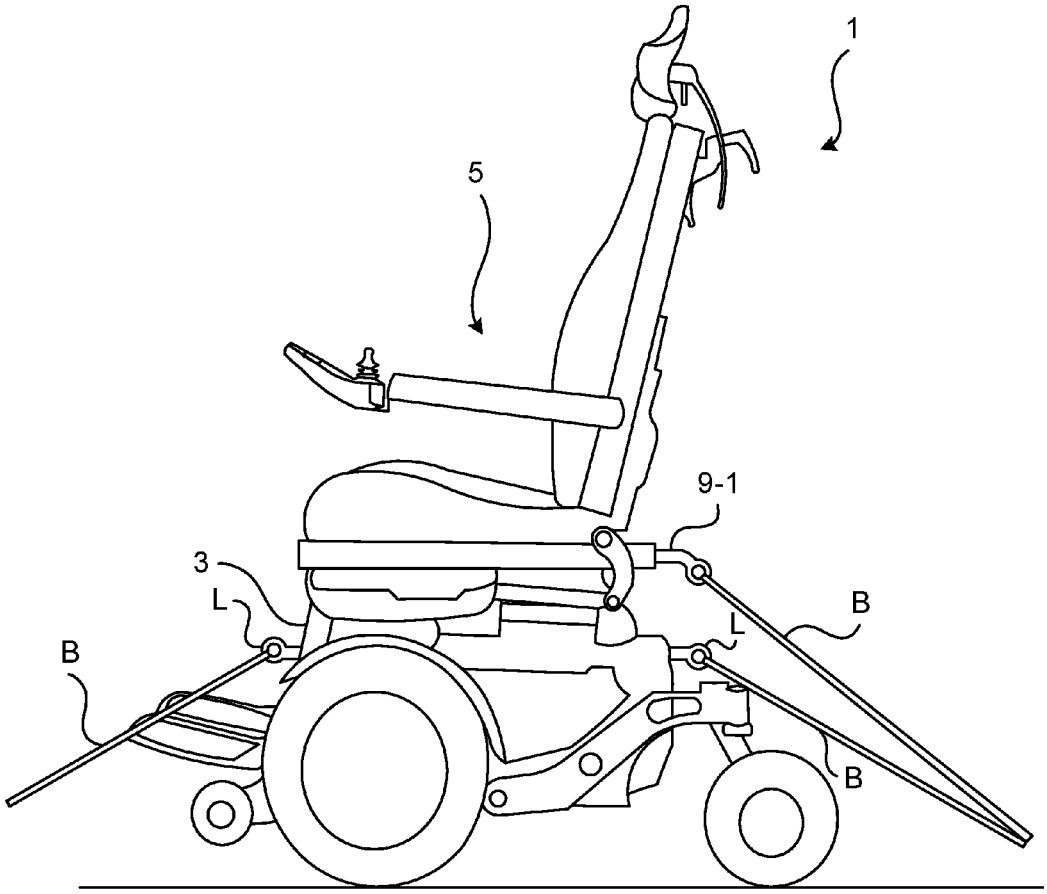
FIG. 3*b* is a schematic side view of another wheelchair fixed inside a vehicle.

FIG. 3*b* shows a variation of a wheelchair for which the energy absorber 9-1 is attached to the seat portion of the seat system 5 instead of the backside of the backrest. Moreover, the loop L is provided at a lower location of the chassis compared to the location of the loop in FIG. 3*a*.

Figure 3C:
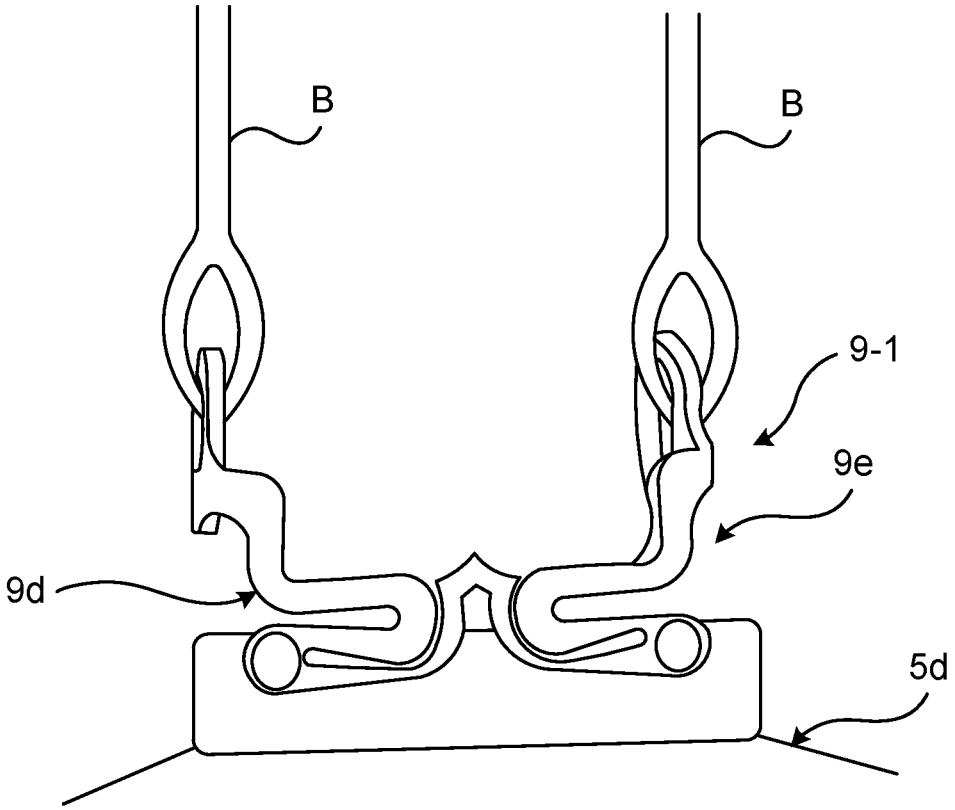
FIG. 3*c* is a top view of the energy absorber in FIG. 2*a* in a normal state when attached to a wheelchair inside a vehicle.

FIG. 3*c* shows a top view of the energy absorber 9-1 in its normal state, i.e. when it has not been subjected to forces which deform it plastically in such a manner that the first leg 9*d* and the second 9*e* are straightened. Pulling forces of a magnitude that is smaller than the predetermined threshold may be counteracted at least to some extent by the curved portion 9*j* which extends beyond the curved portions 9*f* of the first arm 9*d* and the second arm 9*e* and which has a width dimension which is wider than the minimal distance between the facing curved portions 9*f*.

Figure 4A:
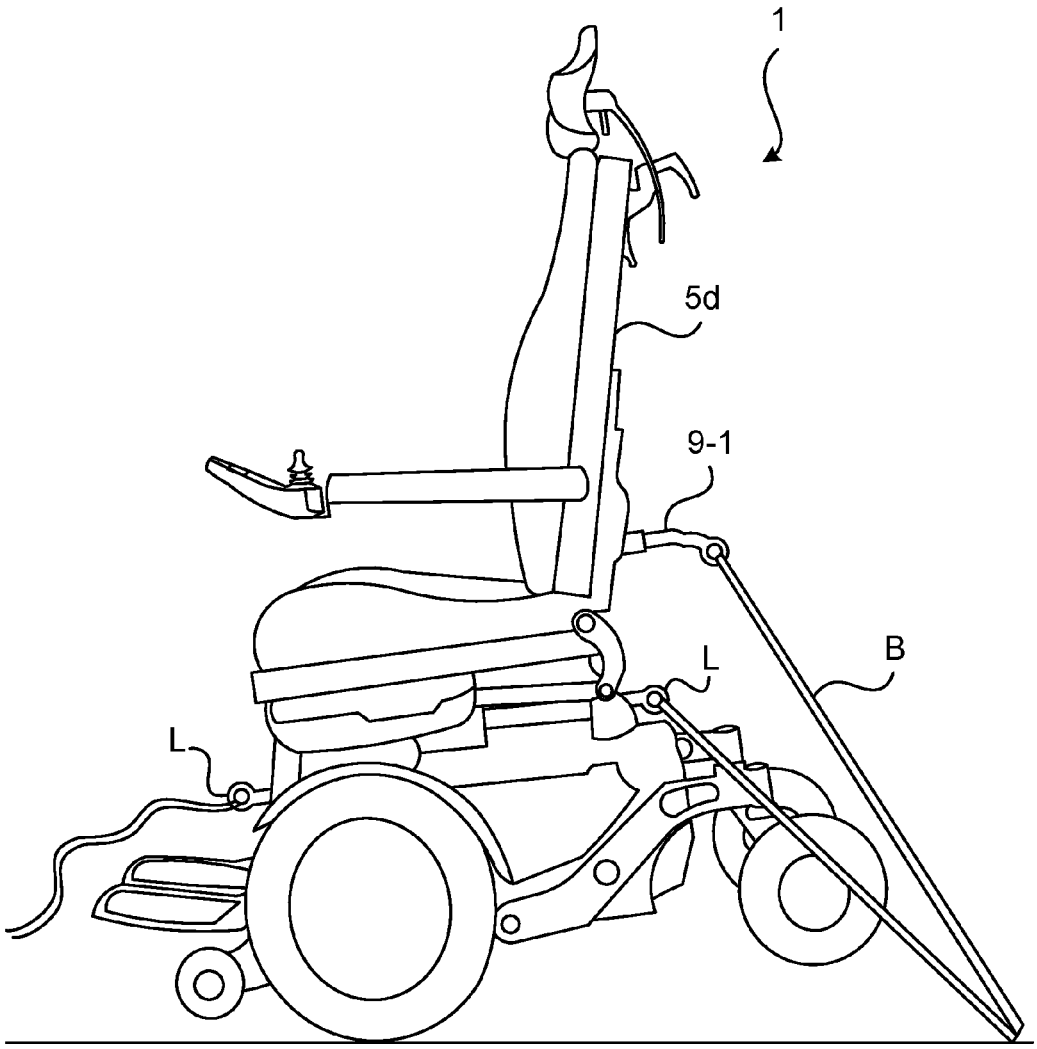
FIG. 4*a* is a schematic side view of the wheelchair in FIG. 1 fixed inside a vehicle during strong deceleration.

FIG. 4*a* shows a side view of the wheelchair 1 in FIG. 3*a* in a process of strong deceleration, for example as a result of a frontal collision. The belts B attached to the loops L of the chassis 3 absorb some of the forces acting on the wheelchair 1. According to the present example, the belts B which are attached to the energy absorber 9-1 subject the energy absorber 9-1 to a pulling force that exceeds the predetermined threshold. The energy absorber 9-1 is plastically deformed in such a way that the first leg 9*d* and the second leg 9*e* are straightened as they absorb energy. Thereby, movement of the backrest 5*b* of the wheelchair 1 in the forward direction is restricted by the length with which the energy absorber 9-1 can be plastically deformed. The backrest 5*b* is hence permitted to move a certain distance forward, until the deformation of the energy absorber 9-1 has been completed. The backrest 5*b* hence follows the motion of the wheelchair occupant and thus the backward momentum of the occupant is reduced as he or she is received by the backrest after the collision impact.

Figure 4B:
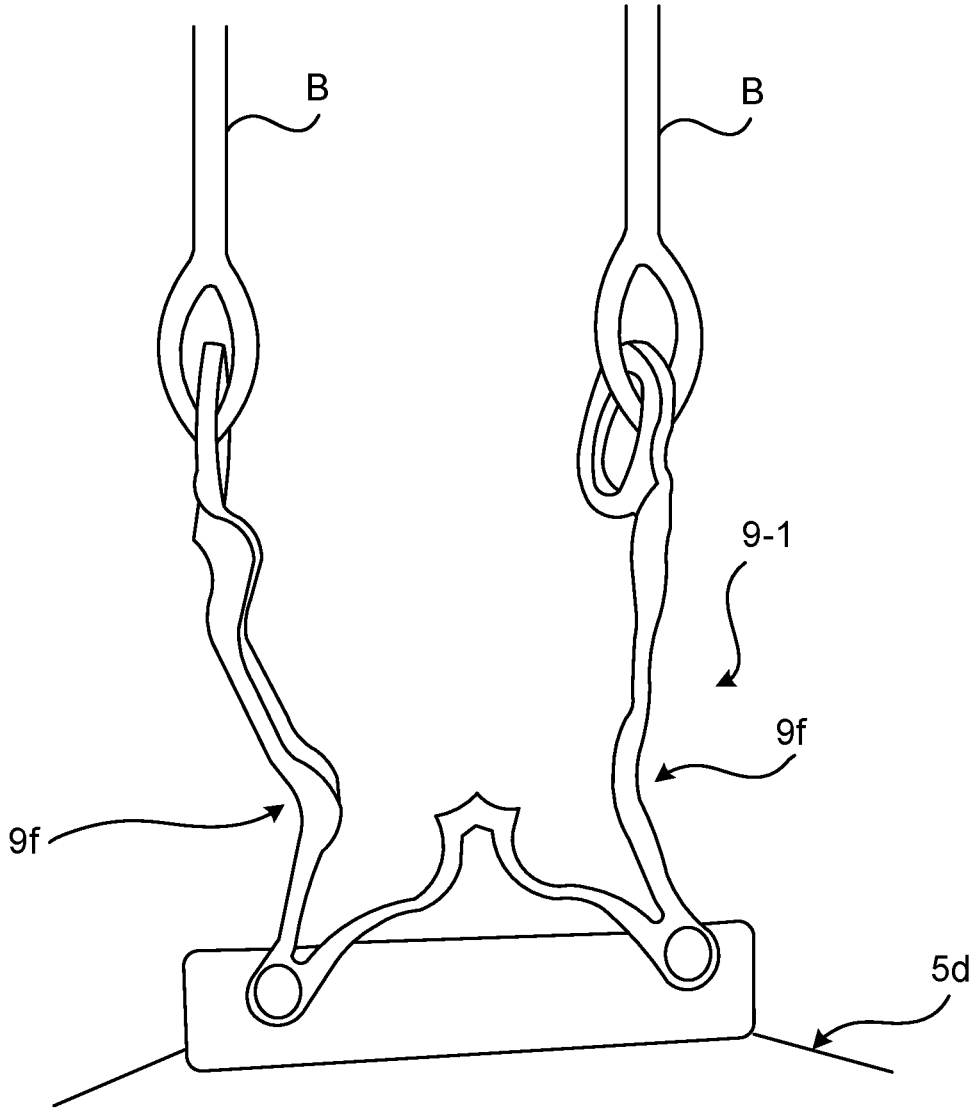
FIG. 4*b* is a top view of the energy absorber in FIG. 4*a*.

FIG. 4*b* depicts a top view of the energy absorber 9-1 after plastic deformation which has straightened the curved portions 9*f*. The wheelchair and the energy absorber presented herein provide safer vehicle travel for light as well as heavy wheelchair occupants. Advantageously, wheelchairs of different user weight classes, including wheelchairs of heavy duty type adapted to carry heavy occupants, may be equipped with the herein presented energy absorber. The geometry of the energy absorber can be modified in order to fit the requirements of a specific user weight class and/or to fulfil various national regulations. For this purpose, the length of the arms and the dimensions of the energy absorber may be modified, and/or the material of which the energy absorber is manufactured may be selected based on these needs and regulations. The length of the legs is a significant design parameter. If the legs are too short, the extension of the legs due to plastic deformation of inter alia the curved portions will be too short until the pulling force increases substantially. Furthermore, for short legs a greater load is necessary to obtain any deformation at all compared to the load needed for deformation of longer legs.

The inventive concept has mainly been described above with reference to a few examples. However, as is readily appreciated by a person skilled in the art, other embodiments than the ones disclosed above are equally possible within the scope of the inventive concept, as defined by the appended claims. For example, the arms of the energy absorber may be physically separated, i.e. there need not be a connecting portion between the arms. It is also envisaged that the energy absorber has just one arm which may be connected in alignment with the symmetry axis of the seat system. Furthermore, the intermediate portion could comprise several curved portions, i.e. a plurality of curved portions.

The invention claimed is:

1. A wheelchair comprising:

a chassis, a seat system attached to the chassis, the seat system having a backrest having a front side and a backside, and a rigid energy absorber having a proximal end attached directly to the backside of the seat system or joined directly with the chassis, a distal end configured to have straps or belts attached thereto, and an intermediate portion extending from the proximal end to the distal end in a direction from the front side towards the back side, wherein the intermediate portion has a fixed curved portion adapted to straighten and plastically deform when the energy absorber is subjected to a pulling force above a predetermined threshold.

2. The wheelchair as claimed in claim 1, wherein the intermediate portion extends from the proximal end to the distal end in one plane.

3. The wheelchair as claimed in any of the preceding claims, wherein the proximal end of the energy absorber is attached to a backside of a seat part of the seat system.

4. The wheelchair as claimed in claim 3, wherein the backside and the proximal end of the energy absorber are configured to be mounted to each other in order to attach the proximal end to the backside of the seat part.

5. The wheelchair as claimed in claim 4, wherein the energy absorber comprises a first mounting structure including openings arranged to receive respective bolts, and wherein the backside of the seat part includes a second mounting structure having corresponding openings.

6. The wheelchair as claimed in claim 1 or 2, wherein the proximal end of the energy absorber is attached to a lower end of the backside of the backrest.

7. The wheelchair as claimed in claim 1, wherein the energy absorber has a first arm and a second arm, each of the first arm and the second arm having a proximal end, a distal end and an intermediate portion which together define the proximal end, the distal end and the intermediate portion, respectively, of the energy absorber.

8. The wheelchair as claimed in claim 7, wherein the intermediate portion of each of the first arm and the second arm each have the curved portion, wherein the curved portion of the first arm faces the curved portion of the second arm.

9. The wheelchair as claimed in claim 8, wherein the energy absorber comprises a connecting portion which joins the proximal ends of the first arm and the second arm.

10. The wheelchair as claimed in claim 9, wherein the connecting portion has a second curved portion which extends in between the curved portion of the first arm and the curved portion of the second arm.

11. The wheelchair as claimed in claim 10, wherein the curved portion of the connecting portion extends beyond the curved portion of the first arm and the curved portion of the second arm in a direction from the proximal end towards the distal end.

12. The wheelchair as claimed in claim 11, wherein the curved portion of the connecting portion which extends beyond the curved portion of the first arm and the curved portion of the second arm has a section which is wider than a minimal distance between the curved portion of the first arm and the curved portion of the second arm.

13. The wheelchair as claimed in any of claims 7-12 wherein the energy absorber is attached symmetrically to a backside of a seat part of the seat system with the first arm attached at one side of a symmetry axis extending in a direction from an end of the backrest which is closest to the chassis towards a headrest end of the backrest and the second arm attached at the other side of the symmetry axis.

14. The wheelchair as claimed in claim 1, wherein the distal end includes loops that enable attachment of the straps or the belts at the distal end.

15. The wheelchair as claimed in claim 1, wherein the energy absorber is made of low carbon steel or low alloy steel.

* * * * *